US007100528B1

(12) United States Patent
Bottom

(10) Patent No.: US 7,100,528 B1
(45) Date of Patent: Sep. 5, 2006

(54) RIGID FLAG REPLICA AND METHODS OF MAKING THE SAME

(76) Inventor: Michael T. Bottom, P.O. Box 546, Cuba, MO (US) 65453-0546

( * ) Notice: Subject to any disclaimer, the term of this patent is extended or adjusted under 35 U.S.C. 154(b) by 15 days.

(21) Appl. No.: 10/976,565

(22) Filed: Oct. 29, 2004

Related U.S. Application Data

(60) Provisional application No. 60/577,540, filed on Jun. 7, 2004.

(51) Int. Cl.
*G09F 17/00* (2006.01)

(52) U.S. Cl. ..... 116/173; 40/427; 40/617

(58) Field of Classification Search ..... 116/173, 116/174, 175; 40/427, 538, 617; D11/165, D11/171
See application file for complete search history.

(56) References Cited

U.S. PATENT DOCUMENTS

| | | | | |
|---|---|---|---|---|
| 1,964,484 | A | 6/1934 | Schroeder | |
| 2,280,817 | A * | 4/1942 | Freeman | 40/545 |
| 2,314,508 | A * | 3/1943 | Monteleone | 40/218 |
| 2,542,919 | A * | 2/1951 | Freeman | 52/77 |
| 2,613,404 | A * | 10/1952 | Jones | 52/77 |
| 2,619,691 | A * | 12/1952 | Bottom | 52/76 |
| 3,419,979 | A | 1/1969 | McVicker et al. | |
| 3,863,415 | A * | 2/1975 | Bott | 52/630 |
| 4,059,914 | A | 11/1977 | Dobson | |
| 4,344,244 | A | 8/1982 | Tyke | |
| 4,611,420 | A * | 9/1986 | Delamere | 40/610 |
| 4,779,369 | A * | 10/1988 | Hill et al. | 40/611.05 |
| 5,224,610 | A | 7/1993 | Veazey | |
| 5,718,072 | A | 2/1998 | Garfinkle | |
| 6,178,678 | B1 * | 1/2001 | Stoddard | 40/618 |
| 6,675,517 | B1 * | 1/2004 | Chia et al. | 40/611.01 |

OTHER PUBLICATIONS

Craft items Known to Inventor.
Country Flag. Aluminum plate frames with waving flags painted thereupon.
Case Arts. Flag Applique for computer cases.

* cited by examiner

*Primary Examiner*—Diego Gutierrez
*Assistant Examiner*—Amy R. Cohen
(74) *Attorney, Agent, or Firm*—Richard L. Marsh

(57) ABSTRACT

A rigid replica of a flag of the United States consists of a background, a field and a plurality of emblems, the background comprising individual U-shaped channels comprising colored red and white horizontal stripes, the field comprising a solid blue panel and the emblem comprising a white star, the channels affixed to spaced apart vertical rafters, the rafters forming a frame of the rigid flag replica, the channels alternately uprightly and invertedly disposed whereby an exposed surface of the uprightly disposed channels is disposed at a different elevation than an exposed surface of the invertedly disposed channels, the uprightly and invertedly disposed channels providing depth and definition to the exposed surface of the rigid flag replica, the blue field having 50 white stars affixed thereto in rows and columns, the blue field applied to the horizontal stripes in an upper left hand corner, the blue field overlying the red and white horizontal stripes.

1 Claim, 4 Drawing Sheets

RIGID FLAG REPLICA AND METHODS OF MAKING THE SAME

RELATED APPLICATION DATA

This application is a non-provisional application of Applicant's provisional application Ser. No. 60/577,540 filed on 7 Jun. 2004.

BACKGROUND OF THE INVENTION

1. Field of the Invention

This invention relates to a rigid flag replica of any nation, organization, state, individual, family, entity or signal flag by arranging a plurality of alternately uprightly and invertedly parallel U-shaped channels horizontally upon a frame whereby an exposed surface of the uprightly disposed channels is disposed at a different elevation than an exposed surface of the invertedly disposed channels.

2. Prior Art Statement

Government standards indicate that a typical cloth flag will last approximately 90 days based on daily usage during daylight hours only. This assumes there will not be inclement weather. Flags flown 24 hours a day may only last one fourth as long. There are also expensive time and maintenance issues involved with cloth flags. Perhaps the most costly item involved with a cloth flag is the cost and installation of a flag pole as the flag pole often costs more than the sum of the flags purchased over an organization's life time.

Planar flags painted upon a flat surface such as building walls or roofs or parts thereof are known to the inventor. Also known to the instant inventor are planar flag decals which may be affixed to a flat surface. For instance, aluminum plate frames with waving flags applied thereto may be found at various decal shops or on the internet site of AutoPlates. Other substantially planar flag appliques may be found at the internet site of CaseArts. Some decal flags have curved stripes to give the appearance of waving, however, the appearance does not change for passersby as no depth nor definition is present in planar flags. Furthermore, planar flags cannot change appearance with respect to oblique lighting. Painted or decal planar flags are also subject to rapid weathering and must be replaced or repaired often. Therefore, there is a need for a rigid flag replica which is low in maintenance, has depth and definition, changes appearance with respect to passersby and/or with respect to oblique lighting and can be constructed of various materials to be assembled on site.

It is known to provide a rigid display board comprising spaced rigid vertical metal frame members, horizontally adjacently arranged sheet metal channel shaped card holders having the webs thereof imposed upon the frame members and secured thereto to provide a generally rectangular rigid structure. For instance, see the U.S. Pat. No. 1,964,484 issued on Jun. 26, 1934, to Theodore E. Schroeder. The display board of Schroeder does not have a background, a field and a plurality of emblems nor are the channels alternately disposed in upright and inverted fashion and therefore, the display board of Schroeder cannot be used to display a flag having raised and lowered surfaces to give an appearance of waving to passersby. Therefore, there is a need for a rigid replica of a flag which has the below described novel features.

It is also known to provide a program display board comprising supporting means including upper and lower rails, a plurality of board units slidably mounted on and between the rails wherein the boards have parallel ribs protruding from one face thereof adapted to receive a plurality of visually distinctive markers snapped over one of the ribs and engaged in a channel between the ribs. For instance, see the U.S. Pat. No. 3,419,979 issued on Jan. 7, 1969 to McVicker, et al. The markers must be stacked one upon the other on each rib and thus could not have a background, a field and a plurality of emblems wherein the background comprises alternately disposed upright and inverted channels. Thus, the program display board of McVicker, et al., cannot be used to display a flag of an organization, nation, state, individual, family or other entity. Therefore, there is a need for a rigid replica of a flag which has the below described novel features.

It is further known to provide a sign board of rigid extruded shallow channels having concave sidewalls. The concave sidewalls are snap-fitted over convex shaped clips of a mounting panel, and when so arranged, provide a planar surface for the sign board. For instance, see U.S. Pat. No. 4,059,914 issued on Nov. 29, 1977 to Dobson. All the channels of Dobson have the same planar face facing outwardly and thus cannot have alternately disposed upright and inverted channels on the same face. Thus, the need for a rigid replica of a flag which has these and other novel features still exists.

Also known in the art is a signage system comprising a frame and at least one removable plate-shaped lettering insert, the frame including a vertical support plate with a horizontal mounting flange which receives the plate-shaped lettering insert thereover. For instance, see the U.S. Pat. No. 4,344,244 issued on Aug. 17, 1982 to Charles R. Tyke. The signage system has plate-shaped lettering inserts across the entire face thereof and thus the entire face does not have alternately elevated and depressed surfaces thereupon. Accordingly, this signage system cannot be used to display a flag of various nations, organizations, states, individuals, families or other entities. Hence, there is a need for a rigid replica of flags of different countries having alternately elevated and depressed surfaces. Similar cumulative U.S. Patents are U.S. Pat. No. 5,224,610 issued on Jul. 6, 1993 to Veazey and U.S. Pat. No. 5,718,072 issued on Feb. 17, 1998 to Garfinkle.

Finally, it is known to provide a metal awning comprising a plurality of pan channels having upwardly directed flanges and a plurality of cover channels having downwardly directed flanges, the pan and cover channels arranged in parallel, alternate, overlapping relation and joined together at the flanges thereof to produce a corrugated top structure. For instance, see the U.S. Pat. No. 2,619,691 issued on Dec. 2, 1952 to J. R. Bottom. The awning produced thereby has found utility as a window or door covering to shield the window or door from the elements, however has not heretofore been utilized for other purposes as the awning comprises only parallel cover and channel pans of certain colors and does not have a separate field applied thereto nor emblems of the entity displayed thereon.

SUMMARY OF THE INVENTION

A primary purpose of this invention is to provide a rigid flag replica that will outlast traditional cloth flags by many years and greatly reduce costs and maintenance while still presenting a "flag" that looks great and can be displayed in good taste.

Another object of this invention is to provide a rigid replica of a flag of the United States that consists of a background, a field and a plurality of emblems, the background comprising individual U-shaped channels comprising colored red and white horizontal stripes, the field comprising a solid blue panel and the emblem comprising a white star wherein the channels are affixed to spaced apart vertical rafters and end plates which form a frame and wherein the channels are alternately uprightly and invertedly disposed whereby an exposed surface of the uprightly disposed channels is disposed at a different elevation than an exposed surface of the invertedly disposed channels, the blue field having fifty (50) white stars affixed thereto in offset rows with the blue field applied to the horizontal stripes in an upper left hand corner thereof and overlying the red and white horizontal stripes.

Still another purpose of this invention is to provide a rigid flag replica that is mounted to a flat surface such as an exterior wall thus eliminating the need for, and cost of, a flag pole.

A major goal of this invention is to provide a rigid flag replica wherein preferably every other stripe or panel has a different elevation that gives the rigid flag replica depth and definition to its exposed surface. This is important because it cannot wave. The different depths of the panels simulate action. If this flag were to be constructed of a single flat sheet of metal or vinyl with stripes simply painted on, it would appear flat and boring similar to a decal, however, it is within the scope of this invention to provide a rigid flag replica comprising individual panels with the outer surfaces thereof substantially at the same elevation above the rafters.

It is also an object of this invention to provide a rigid flag replica having a exposed frontal face, a rear face, bunting end plates and side edges, the rigid flag replica comprising a plurality of initially separate elongated channel elements each channel element having an outer surface, an inner surface and side edges inwardly turned toward the inner surface wherein alternate components of the channel elements are inverted with the inner surface defining a portion of the exposed surface and arranged side edge to side edge with other components of the channel elements wherein the other components have the outer surface defining the remainder portion of the exposed frontal face. The channel elements are then joined together along the side edges thereof to comprise a three dimensional structure giving depth and definition to the exposed frontal face of the rigid flag replica.

Another object of this invention is to provide a rigid flag replica of any nation, organization, state, individual, family or entity as well as signal flags by arranging a plurality of parallel U-shaped channels upon a frame wherein the channels are alternately uprightly and invertedly disposed whereby an exposed surface of the uprightly disposed channels is disposed at a different elevation than an exposed surface of the invertedly disposed channels and wherein the exposed surface of the channels thus presented has the colors of the nation, organization, state, individual, family, signal flag or entity showing forth, and where required, the exposed surface of the channels further having at least one field disposed over a portion thereof with an emblem on either or both of the field or the exposed surface.

A goal of this invention is to provide a rigid flag replica of any nation, organization, state, individual, family or entity as well as signal flags by arranging a plurality of alternately uprightly and invertedly parallel U-shaped channels upon a frame whereby an exposed surface of the uprightly disposed channels is disposed at a different elevation than an exposed surface of the invertedly disposed channels and wherein at least one field may be disposed over a portion thereof with an emblem on either or both of the field or the exposed surface wherein the emblem is selected from the group comprising circles, rectangles, triangles, wedges, trapezoids, crosses, humans, animals, winged creatures, sea creatures, fictional creatures, ancient symbols, earthly bodies, heavenly bodies, coats-of-arms, union jacks, religious symbols, buildings, wreaths, armaments, instruments, tools, letters, inscriptions, plants, insects, landscapes, seascapes, portions thereof and combinations thereof.

An aim of this invention is to provide a rigid flag replica of any nation, organization, state, individual, family, entity or signal flag by arranging a plurality of alternately uprightly and invertedly parallel U-shaped channels horizontally upon a frame whereby an exposed surface of the uprightly disposed channels is disposed at a different elevation than an exposed surface of the invertedly disposed channels and wherein the uprightly disposed channels are of one color and the exposed surface of the invertedly disposed channels is another color.

Another purpose of this invention is to provide a rigid flag replica of any nation, organization, state, individual, family, entity or signal flag by arranging a plurality of alternately uprightly and invertedly parallel U-shaped channels horizontally upon a frame whereby an exposed surface of the uprightly disposed channels is disposed at a different elevation than an exposed surface of the invertedly disposed channels and wherein the exposed surface of at least one uprightly disposed channel and at least one adjacent invertedly disposed channel are of the same color.

Still another aim of this invention is to provide a rigid flag replica comprising a plurality of channel elements affixed to a frame wherein the channel elements comprise a background and the background is adapted to receive at least one field element upon a portion thereof and wherein the background and/or the field may have an emblem affixed thereto, the background, the field element and the emblem identifying a particular faction or nation.

Another goal of this invention is to provide a rigid flag replica of any nation, organization, state, individual, family, entity or signal flag by arranging a plurality of alternately uprightly and invertedly parallel U-shaped channels vertically upon a frame whereby an exposed surface of the uprightly disposed channels is disposed at a different elevation than an exposed surface of the invertedly disposed channels and wherein the exposed surface of at least one uprightly disposed channel and at least one adjacent invertedly disposed channel are of the same color.

Yet another goal of this invention is to provide a rigid flag replica from a window or door awning structure by producing the cover and pan channels of selected colors and in the required number to create a flag background, and where needed, with at least one field and/or at least one emblem upon the field and/or the background to present the flag of any nation, organization, state, individual, family, entity or signal flag.

DESCRIPTION OF THE PREFERRED EMBODIMENTS

While the various features of this invention are hereinafter described and illustrated as a rigid flag replica having an exposed frontal face, a rear face, bunting end plates and side edges, wherein the rigid flag replica comprises plurality of initially separate elongated channel elements each having an outer surface and an inner surface with the side edges thereof inwardly turned toward the inner surface, alternate ones of the channel elements inverted with the inner surface defining a portion of the exposed surface and arranged side edge to side edge with other channel elements having the outer surface thereof defining a remainder portion of the exposed surface, the channel elements thus comprising a three dimensional structure giving depth and definition to the exposed surface of the rigid flag replica, it is to be understood that the various features of this invention can be used singly or in various combinations thereof rigid flag replica as can hereinafter be appreciated from a reading of the following description.

Figure 1:
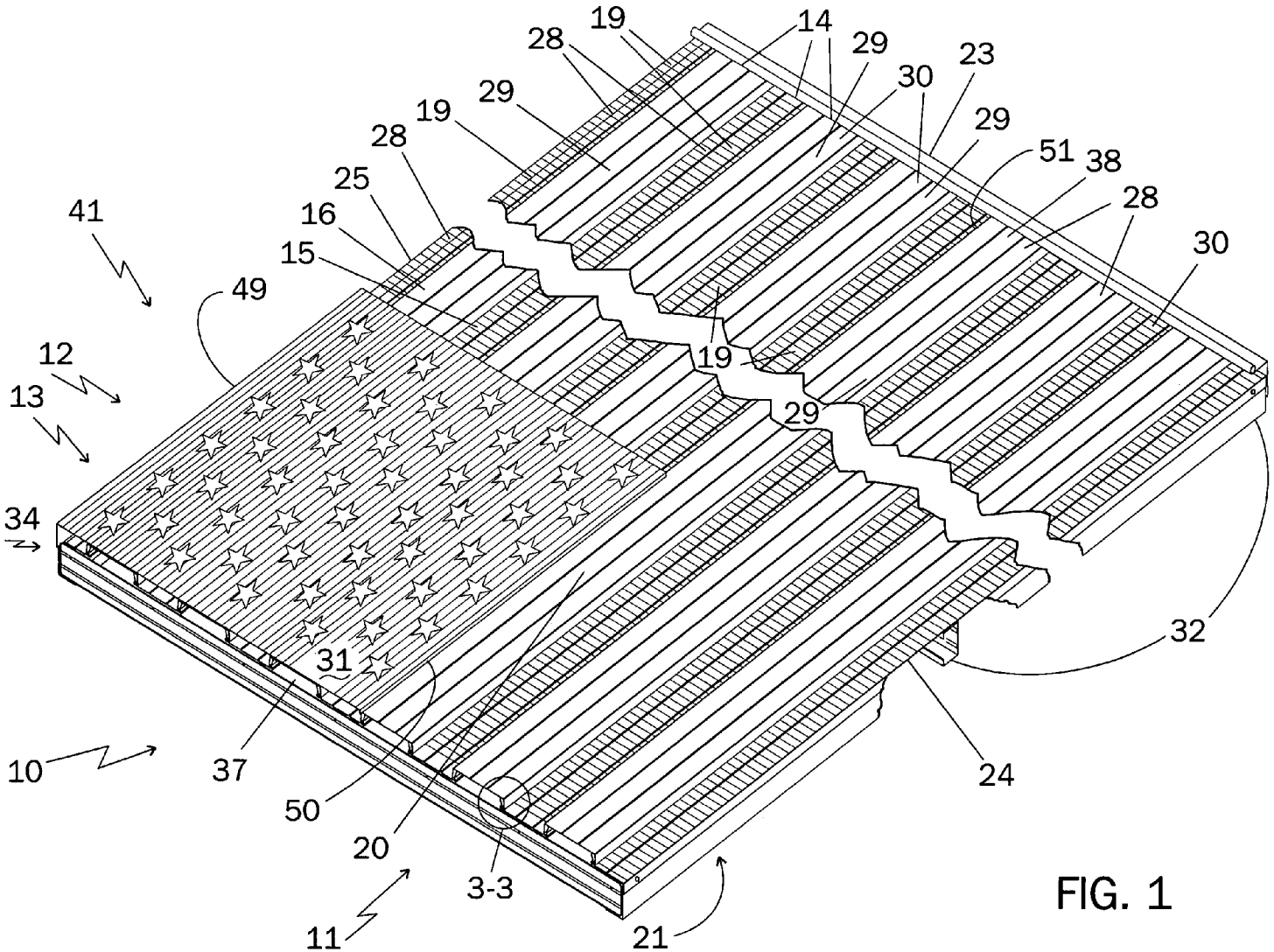
FIG. 1 is a perspective view of the preferred embodiment of the rigid flag replica of this invention.
Figure 2A:
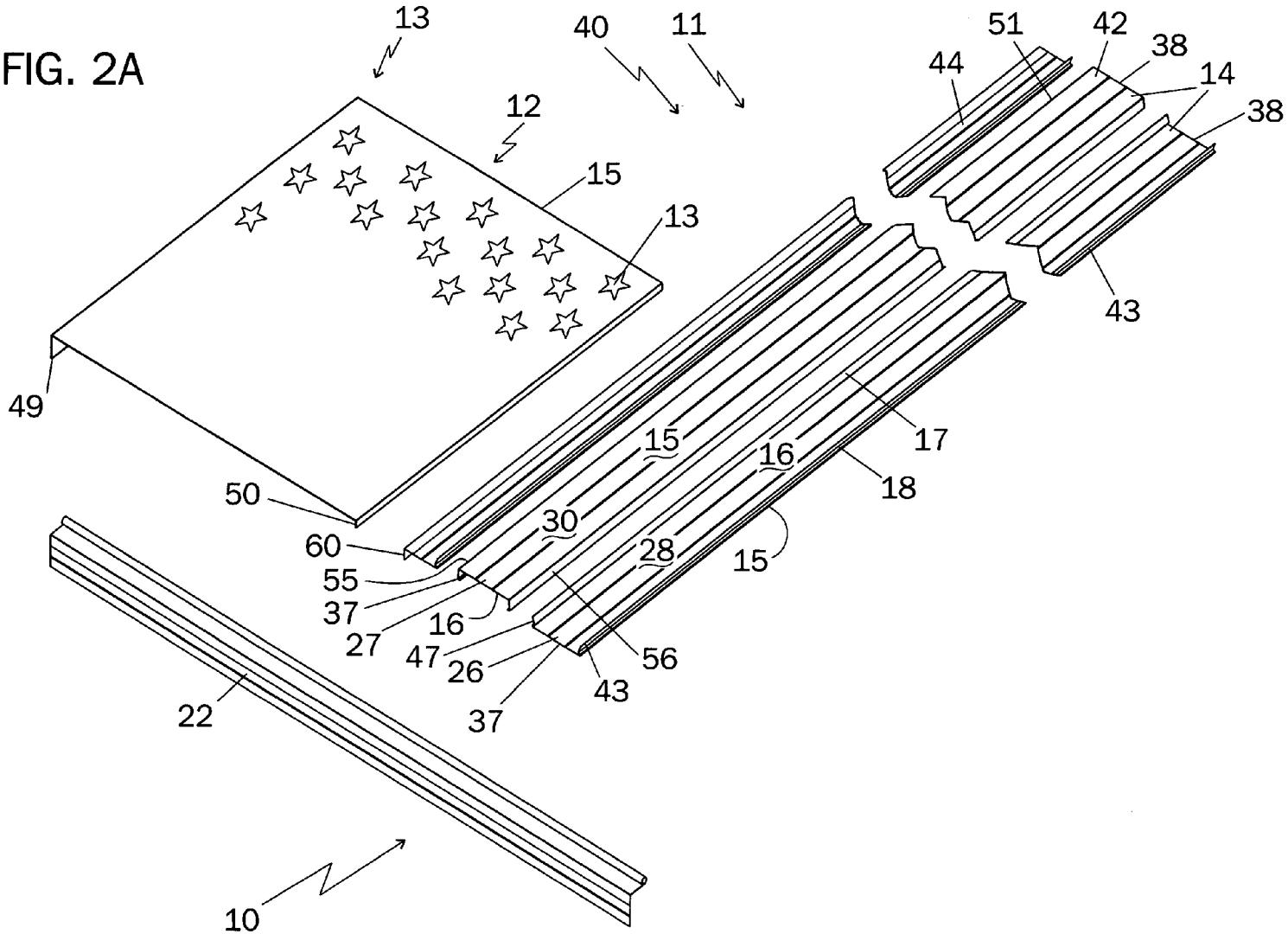
FIG. 2 is an exploded perspective view of the preferred embodiment showing the elements of the preferred embodiment, FIG. 2*a* comprising three channels, one bunting end plate and a field with some emblems affixed thereto, FIG. 2*b* comprising the framework underlying the elements of FIG. 2*a*.
Figure 2B:
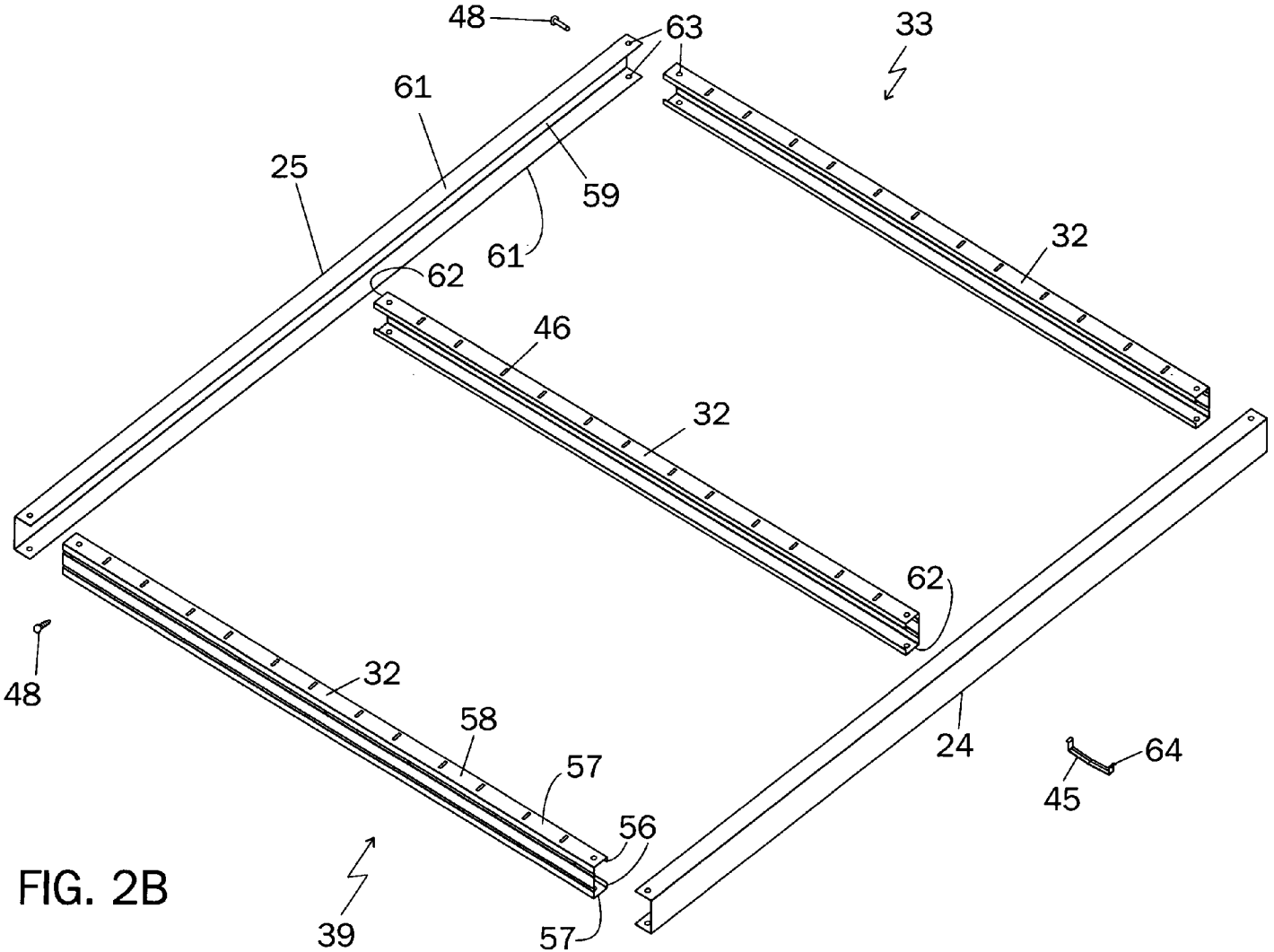

Referring now to FIG. 1, a rigid flag replica, generally shown in FIGS. 1 and 2 with the numeral 10 has an exposed frontal face 20, a rear face 21, bunting end plates 22, 23 and side edge channels 24, 25 and rafters 32 of a frame 33, rigid flag replica 10 comprising a plurality 40 of initially separate elongated channel elements 14 affixed to frame 33. Channel elements 14 have an outer surface 15, an inner surface 16 and side edges 17, 18, side edges 17, 18 inwardly turned toward inner surface 16. Rigid flag replica 10 has alternate components 26 of channel elements 14 inverted with inner surface 16 defining a portion 19 of exposed frontal face 20 and arranged side edge 17 to side edge 18 with other components 27 of channel elements 14 wherein side edges 17, 18 of alternate components 26 are overlapped by side edges 54, 55, respectively, of other components 27 of channel elements 14, outer surface 15 of other components 27 defining a remainder portion 29 of exposed frontal face 20. Alternate components 26 of channel elements 14 are joined together along side edges 17 thereof to side edges 54 of other components 27 and side edges 18 of alternate components 26 of channel elements 14 are joined together to side edges 55 of other components 27 thus comprising a three dimensional structure giving depth and definition to exposed frontal face 20 of rigid flag replica 10.

In the preferred embodiment, a rigid replica of a flag 10 of the United States consists of background 11, field 12 and a plurality of emblems 13, background 11 coincident with exposed frontal face 20, background 11 composed of individual U-shaped channel elements 14 alternately colored red stripe 28 and white stripe 30 on inner surfaces 16 of alternate components 26 and outer surfaces 15 of other components 27 respectively. Field 12 comprises a solid panel 31, dark blue in color, with the plurality of emblems 13 consisting of white stars wherein channel elements 14 are affixed to spaced apart vertical rafters 32, rafters 32 and side edge channels 24, 25 forming frame 33 of rigid flag replica 10. Channel elements 14 are alternately uprightly and invertedly disposed whereby an exposed inner surface 16 of uprightly disposed channels, alternate components 26, is disposed at a different elevation than an exposed outer surface 15 of other components 27, the invertedly disposed channels, uprightly and invertedly disposed components 26, 27, respectively, providing depth and definition to exposed frontal face 20 of rigid flag replica 10. Blue field 12 having fifty white stars affixed thereto in offset rows, is applied to horizontal stripes 28, 30 in an upper left hand corner 34 of rigid flag replica 10, blue field 12 overlying red and white horizontal stripes 28, 30. Channel elements 14 are typically aluminum awning channels overlapped and joined together along side edges 17, 18 as is typical in the construction of awnings with bunting end plates 22, 23 closing the terminal ends 37, 38 of channel elements 14. Rigid flag replica 10 is further described as comprising a support structure 39 and a plurality 40 of replaceable panel elements, support structure 39 comprising rafters 32 and side edge channels 24, 25 affixed together into frame 33 of the desired shape, plurality 40 of panel elements comprising channel elements 14 and at least one field 12. A portion 19 of exposed frontal face 20, that is, inner surface 16 of one selected channel element 14 of plurality 40 of replaceable panel elements, is affixed to support structure 39 at a different elevation from remainder portion 29 of exposed frontal face 20, that is, outer surface 15 of at least one other selected channel element 14 of plurality 40 of replaceable panel elements. Field 12 may then be applied to exposed frontal face 20 at any location thereupon to describe the desired flag. It should be readily apparent therefore, that rigid flag replicas 10 of any nation, organization, state, individual, family or entity as well as signal flags may be produced using a selected combination of panel elements 14 affixed to support structure 39 with emblems 13, when needed, applied to at least one of panel elements 14 and/or field 12.

For instance, rigid flag replica 10 comprising plurality 40 of channel elements 14 disposed upon frame 33 wherein exposed frontal face 20 of plurality 40 of replaceable channel elements 14 comprises a background 11, background 11 having inner surface 16 of alternate channel elements 14 identical in color to outer surface 15 of other channel elements 14. Where no field 12 nor emblem 13 is applied to background 11, and wherein inner surface 16 and outer surface 15 are green, the country of Libya would be represented by rigid flag replica 10. Likewise, the international signal flags Bravo and Quebec would be comprised of channel elements 14 of a single color for inner surface 16 and outer surface 15. By adding field 12 to at least one portion 41, such as upper left hand corner 34, of background 11 which is solid green in color, flags of Bangladesh, Guyana, Jamaica and the Republic of Congo may be constructed. Portion 41 may comprise more than one location and need not be located in upper left hand corner 34. For instance, field 12 for the flag of Bangladesh comprises a red circle centrally disposed on the green colored background 11 while Guyana, Jamaica and the Republic of Congo have at least one triangular shape for field 12 on the green colored background 11. Other national flags having a solid color for background 11 are Antarctica, Bahrain, Bangladesh, Bosnia (old), Bouvet Island, China, Denmark, Dominica, Faroe Islands, Finland, Georgia, Iceland, Japan, Palau, Qatar, Saint Kitts & Nevis, Seychelles, Solomon Islands, Somalia, South Africa, Switzerland, Tanzania, Trinidad, Vietnam with Seychelles a special case wherein any of the colors of the flag could comprise background 11 while four fields 12 of different colored various sized wedge shapes are affixed over background 11. It is also possible to produce the flag of Seychelles by providing different sized triangles of blue, green, white and yellow over a background 11 of red. Likewise, the Alpha, Foxtrot, Hotel, India, Kilo, Lima, Mike, Oscar, Papa, Romeo, Sierra, Uniform, Victor, Whiskey, X-ray, Yankee, Zulu alphabetic signal flags and all the number flags of the international alphabet are constructed with solid background 11 and at least one field 12 applied thereto. Also, by adding at least one emblem 13 to background 11 and/or at least one field 12, the national flags of the nations of Albania, American Samoa, Antigua, Antigua & Barbuda, Arab League, Aruba, Ashmore & Cartier Islands, Australia, Belize, Bermuda, Bhutan, Bosnia & Herzogvina, Brazil, British Virgin Islands, Brunei, Burma, Burundi, Cape Verde, Cayman Islands, Christmas Island, Cocos Islands, Comoros, Cook Islands, Cyprus, Dominican Republic, East Timor, Eritrea, Falkland Islands (Malvinas), Fiji French Southern Territories, Macedonia, Grenada, Guam, Heard & McDonald Islands, Hong Kong, Kazakhstan, Kiribati, Korea, Kyrgyzstan, Lesotho, Maldives, Marshall Islands, Martinique, Mauritania, Micronesia, Montserrat, Morocco, Myanmar, Nanibia, NATO, Netherlands Antilles, New Zealand, Niue, Northern Mariana Islands, Norway, Pakistan, Panama, Papua New Guinea, Pitcairn, S. Georgia & S. Sandwich Islands, St. Helena, Saint Lucia, Sri Lanka, St. Pierre & Miqueion, Samoa, Saudi Arabia, Sweden, Taiwan, Tokelau, Tonga, Tunisia, Turkey, Turkmenistan, Turks & Caicos Islands, Tuvalu, Uganda, United Kingdom, United Nations Organization, United States, Uruguay, USSR(former), U.S. Virgin Islands Zaire and Zambia may be prepared and presented.

Thus, it has been found by the inventor hereof that rigid flag replica 10 of any nation, organization, state, individual, family, entity or signal flag may be prepared with plurality 40 of channel elements 14 horizontally disposed upon frame 33 wherein exposed frontal face 20 of plurality 40 of channel elements 14 comprises background 11, background 11 having inner surface 16 of alternate channel elements 14 of a given color and outer surface 15 of other channel elements 14 of the given or another color, and where required, at least one field 12 and/or emblem 13 applied to background 11 and/or field 12. For instance, the national flag of Panama comprises all white channel elements 14 with one field 12, blue in color, applied over the lower left hand quarter of exposed frontal face 20 and another field 12, red in color applied to the upper right hand quarter of exposed frontal face 20, one emblem 13, a blue star, centrally disposed in the upper left hand quarter of exposed frontal face 20 and another emblem 13, a red star, centrally disposed in the lower right hand quarter of exposed frontal face 20. By following the teachings of this invention, and with reference to a suitable flag reference, such as found at www.theodora.com/flags, the reader hereof is able to construct a rigid flag replica 10 for any purpose.

Rigid flag replicas 10 having only colored horizontal bars of the countries of Armenia, Austria, Botswana, Bulgaria, Colombia, Egypt, Estonia, Gabon, Gambia, Germany, Hungary, Indonesia, Latvia, Lithuania, Luxembourg, Mauritius, Monaco, Netherlands, Organization of African Unity, Poland, Russian Federation, San Marino, Sierra Leone, Tajikistan, Thailand, Ukraine, Yemen, Yugoslavia are constructed according to the teachings of this invention by providing the colors of the selected national flag to sufficient numbers of horizontal channels 14 to produce background 11 for rigid flag replica 10 of the selected country. In a similar manner, the international alphabet flags Charlie, Delta, Echo and Juliette may be produced. Additionally, by applying at least one field 12 to background 11, international signal flag November may be made as well as the national flags of Bahamas, Benin, Czechoslovakia, Czech Republic, Equatorial Guinea, Greenland, Kuwait, Palestine, Sudan, United Arab Emirates. Likewise, by adding at least one emblem 13 to at least one of field 12 or background 11 wherein exposed frontal face 20 comprises horizontal bars of different colors, the national flags of Afghanistan, Angola, Argentina, Azerbaijian, Belarus, Bolivia, Burkina Faso, Cambodia, Central African Republic, Chile, Costa Rica, Croatia, Cuba, Djibouti, Ecuador, El Salvador, Ethiopia, French Polynesia, Ghana, Gibraltar, Greece, Guinea-Bissau, Haiti, Honduras, India, Iran, Iraq, Israel, Jordan, Kenya, Laos, Lebanon, Liberia, Liechtenstein, Malawi, Malaysia, Maura, Mozambique, Nicaragua, Niger, North Korea, Oman, Paraguay, Philippines, Puerto Rico, Sao Tome & Principe, Singapore, Slovak Republic, Slovenia, Spain, Suriname, Swaziland, Syria, Togo, Uzbekistan, Vanuatu, Venezuela, Western Sahara, Zimbabwe may be prepared.

Though the preferred embodiment of rigid flag replica 10 has all channel elements 14 horizontally disposed, rigid flag replica 10 may alternately be constructed as hereinafter described. For instance, rigid flag replica 10 may alternately comprise plurality 40 of channel elements 14 vertically disposed upon frame 33 wherein exposed frontal face 20 of plurality 40 of channel elements 14 comprises background 11, background 11 having inner surface 16 of alternate channel elements 14 identical in color to outer surface 15 of other channel elements 14. Where no field 12 nor emblem 13 is applied to background 11, the national flag of Lybia is again represented when inner surface 16 of alternate channel elements 14 is identical in color to outer surface 15 of other channel elements 14 is green and the Quebec international signal flag is represented when exposed frontal face is entirely yellow. Rigid flag replicas 10 for the countries of Belgium, Chad, Cote D'Ivoire, France, French Guiana, Guadeloupe, Guinea, Ireland, Italy, Mali, Mayotte, New Caledonia, Nigeria, Peru, Reunion, Romania, Wallis & Futuna Islands comprising vertically disposed colored bars may be constructed by providing the required number of vertical channel elements 14 of the required colors. Adding at least one emblem 13 to background 11, rigid flag replicas 10 of the countries Algeria, Andorra, Barbados, Cameroon, Canada, Guatemala, Macau, Malta, Mexico, Moldova, Mongolia, Norfolk Island, Portugal, Rwanda, Saint Vincent and the Grenadines, Senegal and the Vatican may be prepared. Additionally, the Golf, Hotel, Kilo, Tango and numerals 0, 3 and 5 International flags may be similarly constructed. Rigid flag replicas 10 of entities usually having a plurality of parallel horizontal bars are produced by applying fields 12 as horizontal bars upon a background 11 of one color of the entity. It should be readily apparent from the above description then that other organization, state, individual, family or other entity flags may be prepared.

Frame 33 and background 11 for rigid flag replica 10 of the instant invention are preferably prepared and assembled substantially as recited in the aforementioned U.S. Pat. No. 2,619,691 to J. R. Bottom, this patent fully incorporated into this disclosure by this reference thereto, however, rigid flag replica 10 requires that certain color combinations of channel elements 14 be assembled to frame 33 as required by the country flag being produced. In the preferred embodiment, seven red and six white channel elements 14 are assembled to frame 33, beginning with one red end channel or starting pan channel 44 assembled to one side edge channel 24 of frame 33 and alternately assembling white cover channels 42 with red pan channels 43 across frame 33 from side edge channel 24 to side edge channel 25 terminating at side edge channel 25 with a final red starting pan channel 44. Channels 42–44 are affixed to frame 33 with clips formed into rafters 32 as recited in the aforementioned Bottom patent or may be affixed with separate clips 45 which are inserted through apertures 46 in rafters 32 and clipped over inwardly turned edges 47 of pan channels 43. Additionally, pan channels 43 and 44 are preferably also affixed to rafters 32 with fasteners 48, such as pop rivets, screws or the bolts as found in the aforementioned U.S. Pat. No. 2,619,691 to further facilitate assembly of and provide structural rigidity to rigid flag replica 10. The preferred embodiment rigid flag replica 10 of the U.S. Flag then has field 12 applied to upper left hand corner 34 of background 11, one flange 49 of field 12 extending over side edge channel 25 having flange 49 affixed to side edge channel 25 of frame 33. Field 12 may have another inwardly turned flange 50 opposite flange 49, flange 50 abutting top side edge 51 of the fourth cover channel 42 spaced inwardly from side edge channel 25. Field 12 may be further affixed to at least one cover channel 42 with fasteners 48 such as pop rivets. Field 12 then has fifty emblems 13 applied to field 12 in offset rows, emblems 13 comprising white stars applied to field 12. Bunting end plates 22, 23 are then affixed to terminal ends 37, 38 to provide side bunting to rigid flag replica 10.

Rigid flag replica 10 may be alternately constructed of any material having raised and lowered surfaces such as sheet-metal roofing, corrugated metal, metal or thermoplastic awnings, wood or simulated wood fencing, siding or roofing or the like, the raised and lowered surfaces constituting components 26, 27 whereby persons passing by would observe rigid flag replica 10 as having an appearance of movement or waving due to the difference in depth of outer surface 15 above inner surface 16. Additionally, oblique lighting provides a similar effect, especially oblique lighting observed during movement of the lighting source or movement of the observer relative to rigid flag replica 10 and a source of lighting fixed relative to rigid flag replica 10. For instance, it has been observed that rigid flag replica 10, when observed over a period of time from a single vantage point, appears to move during the setting or rising of the sun. Of course, artificial lighting sources may be constructed to give a similar appearance of movement to rigid flag replica 10, or as recited above, movement of a person passing by rigid flag replica 10 having a fixed source of lighting would also give appearance of movement to rigid flag replica 10. It has also been found by the instant inventor that shadowing effects from oblique lighting, whether natural or artificial, enhance the depth and definition of rigid flag replica 10. Rigid flag replica 10 having differing colors on outer surfaces 15 and inner surfaces 16 respectively, appears to move with a greater sense when observed relative to a moving light source or when passersby observe rigid flag replica 10 relative to a fixed source of light. Thus, channel elements 14 may be metal, wood or thermoplastic or combinations thereof and field 12 and/or emblems 13 may also be metal, wood or thermoplastic or combinations thereof though preferably, channel elements 14 are aluminum channel formed from flat aluminum sheet stock, fields 12 are flat aluminum stock with inwardly turned flanges 49, 50 and emblems 13 are high performance vinyl cutouts with adhesive backing. Alternately, emblems 13 may be scroll work from metal, wood or thermoplastic material or may be painted upon fields 12 and/or channel elements 14.

Figure 3:
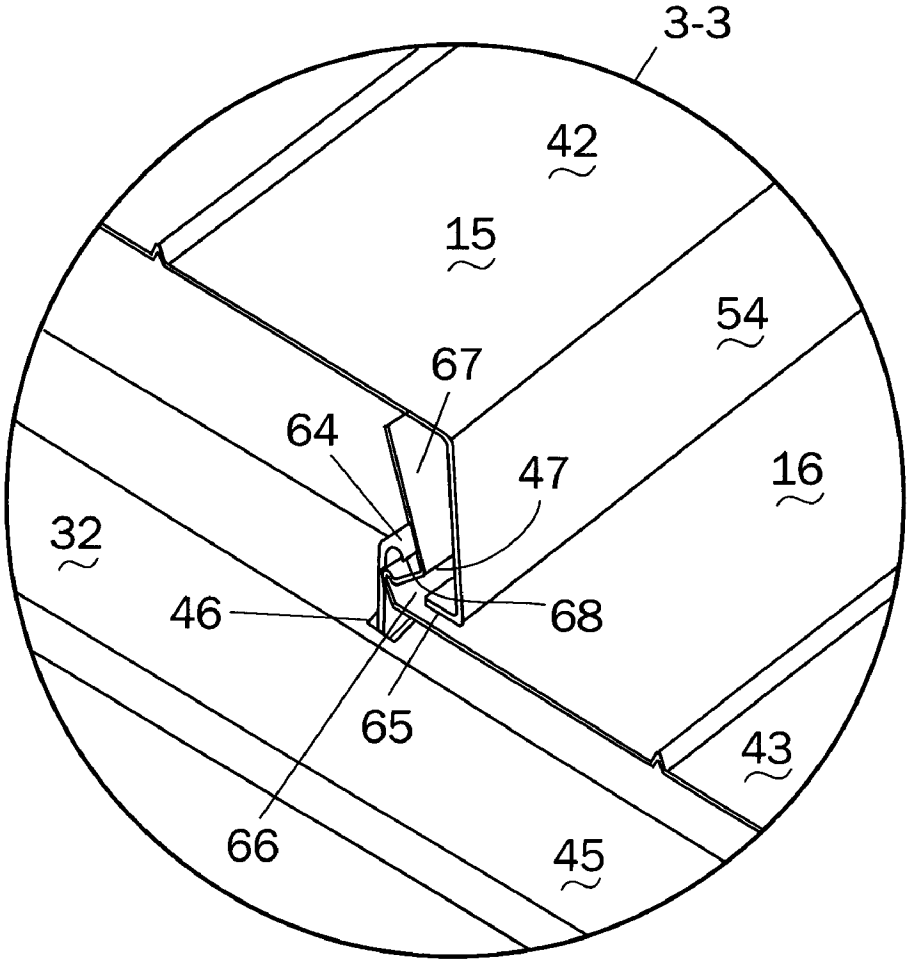
FIG. 3 is a greatly enlarged view of the joinder of components typical of the location shown in circle 3—3 in FIG. 1.

The construction of rigid flag replica 10 consists of each stripe or color made of individual channel elements 14. Channel elements 14 are affixed to a series of vertical rafters 32 behind alternate components 26 of channel elements 14. Rafters 32, along with side edge channels 24, 25 form frame 33 of rigid flag replica 10 as hereinafter described. Rafters 32, bunting end plates 22, 23, side edge channels 24, 25 and clips 45 are preferably made from aluminum flat stock formed into the desired shape of the respective part. For instance, rafters 32 are formed into a C-shape with short inwardly turned structural lips 56 on each side flange 57 thereof to provide structural strength to rafters 32. Rafters 32 are preferably slightly smaller as measured across the outside surface 58 of side flanges 57 such that rafters 32 may be readily installed into U-shaped side edge channels 24, 25 without distortion of side edge channels 24, 25. Rafters 32 are cut to a length equal to the sum of the width of assembled channel elements 14 less the thickness of the base 59 of both U-shaped side edge channels 24, 25 and the thickness of downwardly directed flanges 60 of both end or starting pan channels 44. Side channels 24, 25 are formed from flat stock into a U-shape with a flat base 59 and side uprights 61 and are cut to the length of channel elements 14 thus establishing the desired width of rigid flag replica 10. Side uprights 61 receive rafters 32 therebetween with rafters 32 have fasteners 48 joining the ends 62 of rafters 32 to side uprights 61 through holes 63 in side flanges 57 of rafters 32 and side uprights 61. Preferably, pop-rivets are used, however, sheet metal screws, bolts or other fastening means may be used to advantage. The number of rafters 32 is determined by the total width and length of rigid flag replica 10 and therefore is usually at least 3. Once frame 33 is assembled with side edge channels 24, 25 affixed to rafters 32, clips 45 are inserted into apertures 46 through side flanges 57 of rafters 32 at the locations of the joinder of all channels 42–44. Referring now to FIG. 3, clips 45 have outwardly rolled ends 64 which are received over rolled edge 67 of pan channels 43, rolled edge 67 having a bight 66 internally thereof, bight 66 receiving ears 65 formed on the terminal end of side edges 54, 55 of cover channels 42 therein thus joining channels 42, 43 together and to rafters 32. End channels 44 are similarly joined to cover channels 42 internally of side edge channels 24, 25 through aperture 46 with clip 45, downward directed flange 60 of end channels 44 overlapping side edge channels 24, 25 and joined thereto with fasteners 48. Pan channels 43 are first joined to clips 45 by rolling one rolled edge 67 under outwardly rolled end 64 of clip 45 and snapping other rolled edge 67 behind the terminal end 68 of outwardly rolled end 64 of an adjacent clip 45. Thus, pan channels 43 are joined to rafters 32 at both side edges 17, 18 by separate clips 45 through separate apertures 46. Cover channels 42 have one ear 65 placed into bight 66 of one pan channel 43 with the other ear 65 snapped into bight 66 of an adjacent pan channel 43 until all cover channels 42 are joined to pan channels 43 for the required height of rigid flag replica 10. End channels 44 are then snapped into the last remaining bight 66 of pan channels 43 near side edge channels 24, 25 with downwardly directed flanges 60 overlapping side edge channels 24, 25, downwardly directed flanges 60 fastened to side edge channels 24, 25 with fasteners 48. In the above construction of rigid flag replica 10, every other channel element 14 has a different elevation that gives rigid flag replica 10 depth and definition to exposed face 20 which is important because rigid flag replica 10 cannot wave. Thus, the different depths of channel elements 14 simulate action to rigid flag replica 10 to passersby whom are constantly observing rigid flag replica 10 from a different angle. It should be clear then that if rigid flag replica 10 were constructed of a single flat sheet with stripes simply painted thereupon, rigid flag replica 10 would not have a changed appearance to moving passersby. It should also be clear that oblique lighting would provide a similar effect, especially oblique lighting observed during movement of the lighting source or movement of the observer relative to rigid flag replica 10 and a source of lighting fixed relative to rigid flag replica 10. For instance, rigid flag replica 10, when observed over a period of time from a single vantage point, appears to move during the setting or rising of the sun. Of course, artificial lighting sources may be associated with flag replica 10 to give the appearance of movement to rigid flag replica 10, or alternately, movement of a person passing by rigid flag replica 10 having a fixed source of lighting would also give appearance of movement to rigid flag replica 10. Rigid flag replica 10 having differing colors on outer surfaces 15 and inner surfaces 16 respectively, appears to move with a greater sense when observed relative to a moving light source or when passersby observe rigid flag replica 10 relative to a fixed source of light.

For flags of nations, organizations, states, individuals, families, entities or signals having only a solid background 11 of a single color or only horizontal stripes, the above construction is complete, however, for flags of nations, organizations, states, individuals, families, entities or signals that have other adornment, at least one field 12 and/or at least one emblem 13 may be affixed to rigid flag replica 10. For instance, field 12, formed from a flat sheet of rigid material into a shallow U-shape may be affixed to background 11 by affixing at least one of side flanges 49, 50 to at least one side edge 54, 55 of cover channels 42 and/or at least one side edge channel 24, 25 with fasteners 48. Alternately or additionally, at least one emblem 13 may be affixed to background 11 and/or field 12 in a similar manner where emblem 13 comprises a flat sheet of rigid material or emblem 13 may be adhered to background 11 and/or field 12 where emblem 13 is formed from a flat sheet of flexible material such as an adhesive backed vinyl.

The size of rigid flag replica 10 is changed by using multiple number of stripes of the same color therefore increasing the height of that color and thus adjacent cover and pan channels 42, 43 are the same color but are still joined as recited above. The length of rigid flag replica 10 would vary according to the flag height in order to keep its proportion. Field 12 and emblem 13 would also be changed in size to keep proportion to the desired rigid flag replica 10. Though rigid flag replica 10 has been described to be constructed substantially as recited in the aforementioned U.S. Pat. No. 2,619,691 to J. R. Bottom, rigid flag replica 10 may be made according by any of the methods of construction generally used for awnings. Of course, it is also within the scope of this invention to apply paint to background 11 for field 12 and/or emblem 13 without departing from the teachings herein described.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A rigid replica of a flag of the United States consists of a background, a field and a plurality of emblems, said background comprising individual U-shaped channels comprising colored red and white horizontal stripes, said field comprising a solid blue panel and said emblem comprising a white star, said channels affixed to spaced apart vertical rafters, said rafters forming a frame of said rigid flag replica, said channels alternately uprightly and invertedly disposed whereby an exposed surface of said uprightly disposed channels is disposed at a different elevation than an exposed surface of said invertedly disposed channels, said uprightly and invertedly disposed channels providing depth and definition to said exposed surface of said rigid flag replica, said blue field having fifty (50) white stars affixed thereto in rows and columns, said blue field applied to said horizontal stripes in an upper left hand corner, said blue field overlying said red and white horizontal stripes.

* * * * *